US005589859A

United States Patent [19]

Schantz

[11] Patent Number: 5,589,859

[45] Date of Patent: Dec. 31, 1996

[54] INKJET PRINTHEAD ELECTRICAL CONNECTIONS

[76] Inventor: Christopher A. Schantz, 939 Shell Blvd. #205, Foster City, Calif. 94404

[21] Appl. No.: 541,657

[22] Filed: Oct. 10, 1995

Related U.S. Application Data

[63] Continuation of Ser. No. 419,970, Apr. 7, 1995, abandoned, which is a continuation of Ser. No. 113,161, Aug. 27, 1993, abandoned.

[51] Int. Cl.[6] ..... B41J 2/32

[52] U.S. Cl. ..... 347/19; 347/50

[58] Field of Search ..... 347/19, 37, 49, 347/50, 58; 400/88

[56] References Cited

U.S. PATENT DOCUMENTS

| | | | |
|---|---|---|---|
| 4,379,988 | 4/1983 | Mattatall | 320/4 |
| 4,706,097 | 11/1987 | Harmon | 346/139 C |
| 4,755,836 | 7/1988 | Ta et al. | 347/49 |
| 4,907,018 | 3/1990 | Pinkerpell et al. | 346/139 R |
| 5,057,855 | 10/1991 | Damouth | 347/57 |
| 5,117,244 | 5/1992 | Yu | 347/29 |
| 5,182,583 | 1/1993 | Horigome et al. | 346/140 R |
| 5,257,042 | 10/1993 | Buhler | 347/64 |

FOREIGN PATENT DOCUMENTS

| | | | |
|---|---|---|---|
| 0476398A2 | 3/1992 | European Pat. Off. | B65C 9/44 |
| 3806356 | 6/1988 | Germany | B41K 1/100 |
| 55-091678 | 11/1980 | Japan | B41J 3/04 |
| 56-063635 | 5/1981 | Japan | G06F 3/02 |
| 62-116172 | 5/1987 | Japan | B41J 3/28 |
| 62-256666 | 11/1987 | Japan | 346/76 PH |
| 5069577 | 3/1993 | Japan | B41J 2/35 |

*Primary Examiner*—Benjamin R. Fuller
*Assistant Examiner*—Craig A. Hallacher

[57] ABSTRACT

A scanning head printer includes a battery that is onboard a reciprocating printhead for providing power necessary for printing onto a medium, such as a sheet of paper. In a second embodiment, the drive signals for firing ink from the scanning printhead are transmitted in a wireless fashion. If both the onboard battery and the wireless transmission are combined, the scanning printhead can be free of restrictive cables that link the printhead to stationary circuitry. Preferably, the printhead includes power-conditioning circuitry. A stationary primary coil may be employed for inductive coupling to a recharge coil that is mounted for movement with the printhead and the onboard battery, thereby permitting recharging of the battery when the printhead is in a rest position.

16 Claims, 4 Drawing Sheets

INKJET PRINTHEAD ELECTRICAL CONNECTIONS

CROSS-REFERENCE TO RELATED APPLICATION(S)

This is a continuation of application Ser. No. 08/419,970 filed on Apr. 7, 1995, now abandoned, which is a continuation of application Ser. No. 08/113,161 filed on Aug. 27, 1993, now abandoned.

TECHNICAL FIELD

The present invention relates generally to printers having scanning printheads and more particularly to providing power and drive signals to an inkjet printhead.

BACKGROUND ART

A thermal inkjet printer includes a printhead having an array of nozzles. Each inkjet nozzle comprises a resistor patterned on a substrate using conventional thin-film fabrication procedures. Ink is allowed to flow into the resistor area, whereafter heating the resistor causes the ink to essentially boil and a tiny droplet of ink is "fired" from the nozzle. The printhead is mounted on a cartridge having a supply of ink for replenishing the nozzles as they are fired.

A printer may have a full-width head or may have a scanning head that is caused to move in a direction perpendicular to a paper path in order to print across the width of a sheet of paper. In inkjet technology, a first level of connection from a scanning printhead is made to a flex circuit. Referring to FIGS. 1*a* and 1*b*, an inkjet cartridge 10 is shown as including a housing 12 for storing a reservoir of ink. A printhead 14 having nozzle openings 16 is mounted on one side of the cartridge. Drive signals to heat the resistors of the printhead are provided by traces 24 on a dielectric material 22. Raised contact pads 23 are located at the ends of the traces 24 opposite to the printhead. The flex circuit that comprises the dielectric material 22, the raised contact pads 23 and the traces 24 provides a first level of interconnect from outside circuitry to the resistors of the printhead 14.

The second level of interconnect is from the raised contact pads 23 to a flexible interconnect strip having parallel interconnect lines that extend to stationary logic circuitry of the printer. Referring now to FIG. 2, a flexible interconnect strip 26 includes raised bumps, not shown, that are in registration with the raised contact pads on the dielectric material 22 on the housing 12 of the inkjet cartridge. A snap-spring metal member 28 is fixed to a molded-in carriage 30 by engagement with a ledge member 32 on the cartridge. On the side of the flexible interconnect strip 26 that is opposite to the dielectric material 22 is a series of spring pad bumps, not shown, that urge the raised contact areas of the interconnect strip against the raised contact pads of the flex circuit of the cartridge. These spring pad bumps are described in detail in U.S. Pat. No. 4,907,018 to Pinkerpell et al., which is assigned to the assignee of the present application. When the housing 12 is pivoted to a vertical position as shown by arrow 34, the force provided by the snap-spring metal member 28 aids in obtaining proper electrical contact between the flex circuit and the flexible interconnect strip 26.

Also shown in FIG. 2 is a support member 36 having a bore 38. The circumference of the bore 38 acts as a bearing surface against a stationary carriage rod, not shown, along which the carriage is driven to relocate the printhead across the width of a paper on which ink is to be deposited. Also shown is an interposer arm 40 secured in a shaft 42. The function of the interposer arm is related to mechanically triggering certain features of a service station close to which the carriage resides when printing operations are completed.

A thermal inkjet printer sold by Hewlett-Packard under the trademark DeskJet has an array of fifty drop ejectors. Each drop ejector has a thin film resistor having an electrical resistance of approximately 26.8 ohms. A drop firing pulse of a drive signal is approximately 14.8 μJ in energy, with a pulse width of 3.25 μsec. A maximum repetition rate is 3.6 KHz. That is, the operating frequency of the printhead is 3.6 KHz. Consequently, the peak instantaneous power for each resistor is 14.8 μJ/3.25 μsec=4.55 Watts. It follows that the peak current is $(4.55 \text{ Watts}/26.8 \text{ ohms})^{0.5}=0.41$ amps. Returning to FIGS. 1*a* and 1*b*, each raised contact pad 23 and its associated trace 24 must therefore be designed for a peak current of 0.41 amps.

At the maximum repetition rate of 3.6 KHz, in which the firing pulses have a period of 277 μsec, the average current per drop ejector is 0.41 amps×(3.25 μsec/277 μsec)=0.0048 amps. If the printing requirements are such that all of the fifty drop ejectors fire simultaneously in a "blackout" mode, the total current is (50×0.0048 amps)=0.24 amps. Each of the four common contacts of the printer must therefore be designed for a maximum continuous current of (0.24 amps/4)=0.06 amps.

The raised contact pads 23 must be capable of carrying high peak currents and must have a very low contact resistance to the interconnect strip in order to ensure uniform drive currents to the resistors of the multi-nozzle printhead 14. To achieve a low contact resistance, the pads 23 are made as large as feasible and are plated with gold. Therefore, the interconnect structure plays a major role in the overall cost of the inkjet cartridge 10. Since many of the cartridges used in inkjet printers are disposable cartridges, the cost recurs with use of a printer.

Another difficulty with the conventional design described above is that the need for connection at the interface of the cartridge flex circuit and the interconnect strip places constraints on the design of the remainder of the printer system. For example, an accurately located flat surface of several square centimeters is required for the connection, both on the inkjet cartridge and on the carriage of the printer. Another concern is that the flexible interconnect strip 26 of FIG. 2 should be low in cost, but must be capable of repeated flexing as the carriage 30 moves from side to side during the printing process.

An object of the present invention is to provide a scanning head printer in which electrical connections to a head are achieved in a reliable, low cost design.

SUMMARY OF THE INVENTION

The above object has been met by eliminating the need of high peak-current electrical connections from stationary drive circuitry to a scanning printhead. In a first embodiment, the structure that is caused to scan with the printhead includes a battery which provides power for actuating print generators, such as thermal inkjet nozzles. With an onboard power source, the drive signals for triggering the inkjet nozzles can be less current-demanding. For example, each inkjet nozzle may be associated with a switching device that selectively links the nozzle to the onboard battery when the low current drive signal triggers the switch. In this embodiment, the reduction in peak current at electrical connectors translates to a reduction in the desirability of a costly electrical path from stationary drive circuitry to the scanning head.

In a second embodiment, the battery may be stationary, but the drive signals are transmitted to the scanning head in a wireless manner. For example, a series transmission of drive information may be sent to the scanning head using an infrared transmitter. An infrared sensor may be incorporated into the silicon chip that forms an array of inkjet nozzles, or the sensor may be on a side of a print cartridge, with electrical connection from the sensor to the printhead being made with a flex circuit. Other optical approaches may be used, such as fiberoptic technology. Alternatively, radio frequency transmission may be employed.

In the second embodiment, the required electrical connections from a stationary structure to the scanning head are reduced to power connections. However, in a preferred embodiment, the wireless transmission of drive signals is combined with an onboard battery, so that no wires or electrical interconnects are required.

Power conditioning circuitry may be provided onboard the scanning head to regulate battery power. In inkjet printing, the requirement that a substantial percentage of the nozzles fire simultaneously may reduce the current to the nozzle resistors to less than the optimal level. Voltage regulation will minimize current drops. The power conditioning circuitry may be formed within the semiconductor chip of an inkjet printhead.

Where an onboard battery is employed, the scanning structure may also include a proximity coil that is located for inductive coupling with a stationary coil on the printer. The proximity coil can be connected to the battery in order to recharge the battery. For example, the stationary coil may be mounted for inductive coupling to the scanning coil when the printhead is in a rest position following a printing operation.

An advantage of the present invention is that electrical connections capable of high peak current transmission need not be made between a stationary device and a scanning print device, such as an inkjet printhead. At most, a low current switch signal is to be transmitted at a printhead-carriage interface. Another advantage is that the electrical connection is made in a reliable manner. Any onboard battery is preferably rechargeable. However, a non-rechargeable battery can be employed in use with ink cartridges that are designed to be disposable, thereby adding a disincentive to attempting to refill a disposable cartridge.

BEST MODE FOR CARRYING OUT THE INVENTION

Figure 1A:
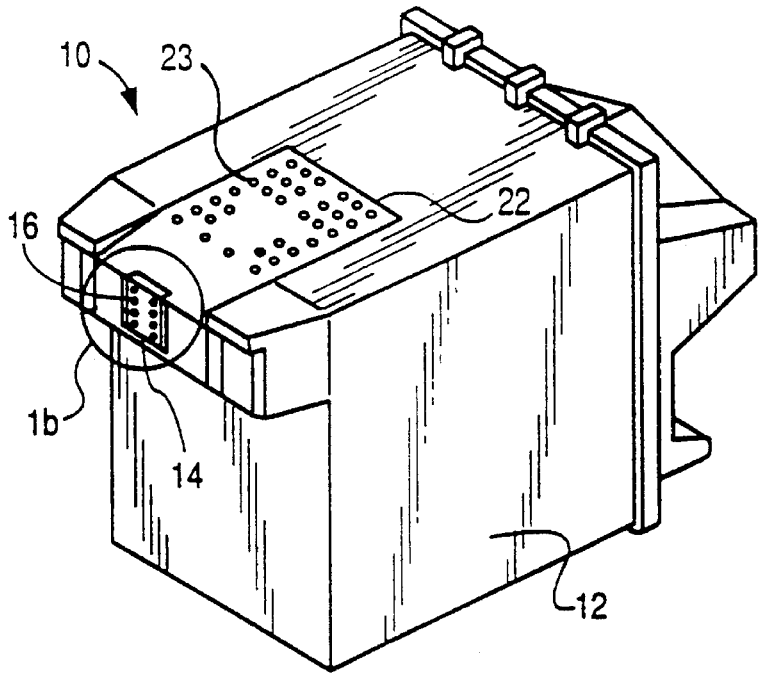
FIG. 1a (PRIOR ART)
FIG. 1*a* is a perspective view of a prior art inkjet cartridge.
Figure 1B:
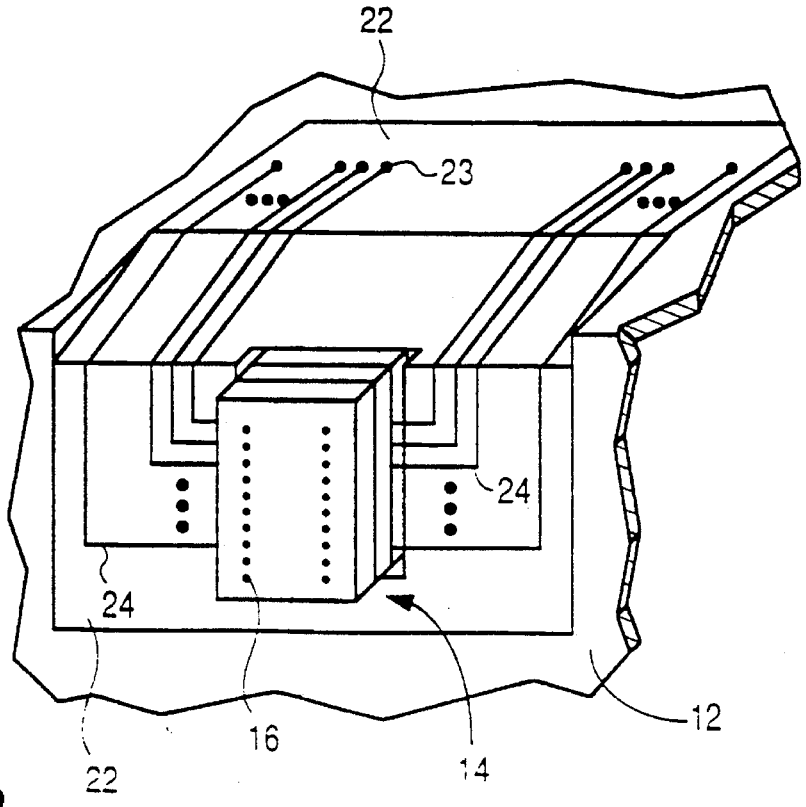
FIG. 1b (PRIOR ART)
FIG. 1*b* is a perspective view of the prior art inkjet cartridge of FIG. 1*a*, shown within the circle 1*b*.
Figure 2:
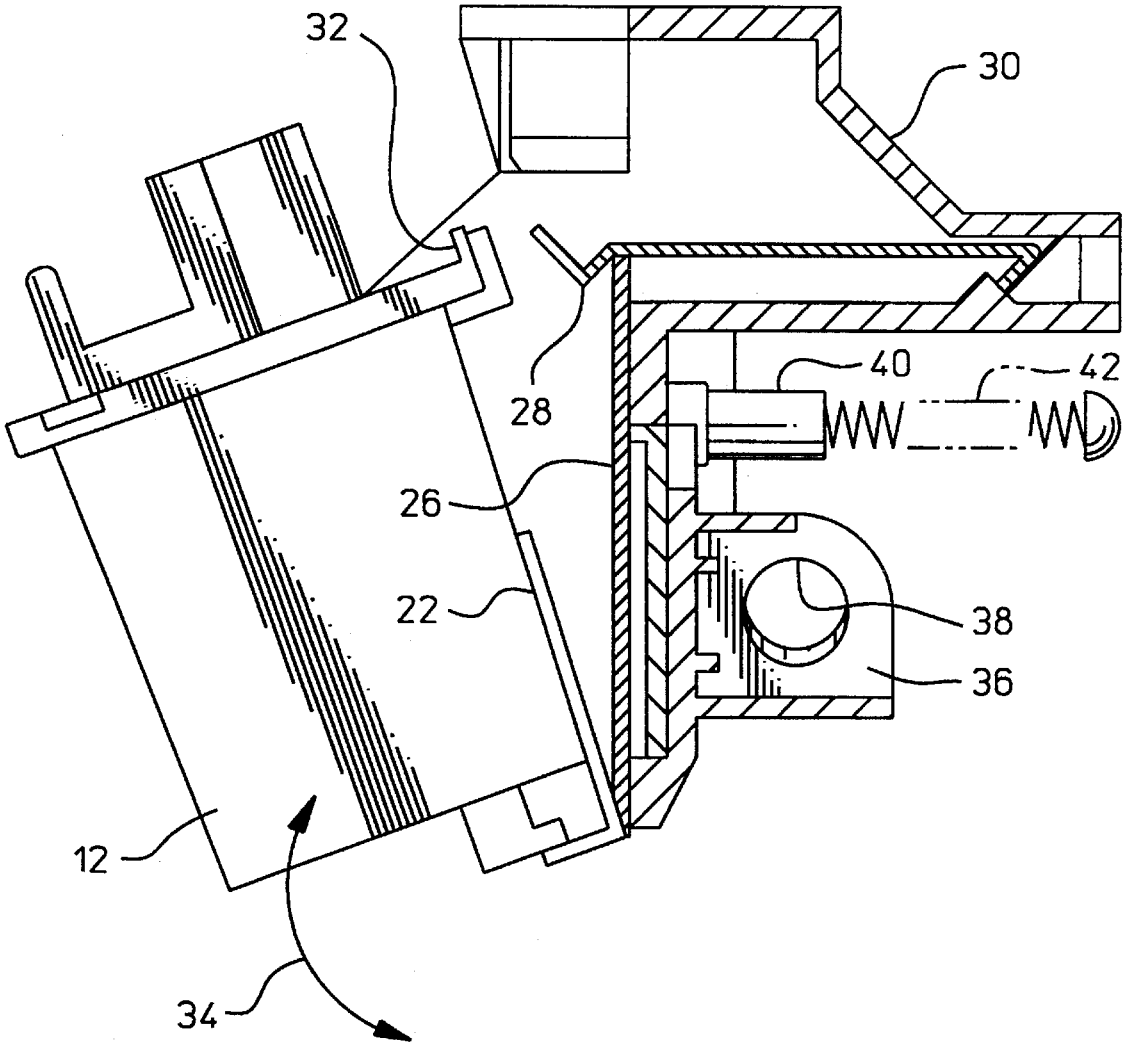
FIG. 2 (PRIOR ART)
FIG. 2 is a side view of the inkjet cartridge of FIG. 1*a* prior to attachment to a carriage, in accordance with a prior art technique.
Figure 3:
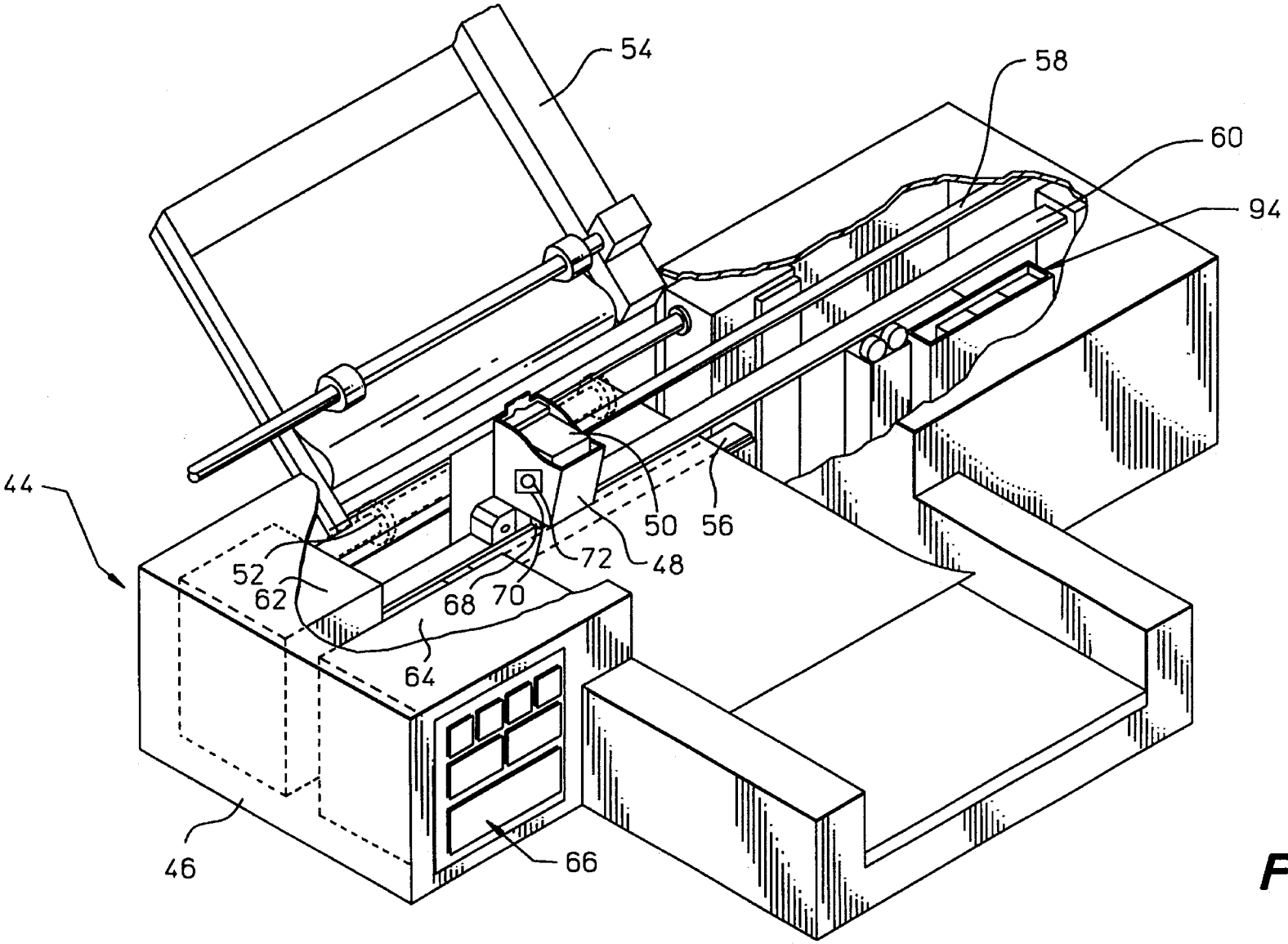
FIG. 3 is a perspective view of a printer having a scanning head in accordance with the present invention.

With reference to FIG. 3, an inkjet printer 44 is shown as including a stationary housing 46 and a carriage 48 for scanning an inkjet cartridge 50 across a paper path. Drive rollers 52 feed paper, or another print medium, from a paper supply 54 to a printing zone disposed between the cartridge 50 and a platen 56.

The printhead carriage 48 travels in a direction perpendicular to the paper path on a carriage rod 58 and a carriage guide 60. The printhead carriage is driven by a belt, not shown, connected to a drive motor 62. A microprocessor system 64 having a control panel 66 governs movement of the printhead carriage and other operations of the printer 44. Printing operation controlled by a microprocessor is known in the art.

Depending downwardly from the cartridge 50 is an inkjet printhead 68. While the present invention is described and illustrated as being used with a thermal inkjet printhead, the invention is applicable to use with other types of scanning heads. Ink that is to be released from the printhead 68 is stored in the upper portion of the cartridge 50. In a less preferred embodiment, an ink cartridge is stationary and supplies ink to a moving printhead via a hose or the like.

The microprocessor 64 generates drive signals that control the release of ink from the printhead 68. In prior art printers, the drive signals are conducted through a flexible interconnect strip to the scanning cartridge and pressure contact is made between the interconnect strip and a flex circuit on an inkjet cartridge. The drive signals of the prior art must have sufficient power to cause a resistor to heat sufficiently to eject a drop of ink from a nozzle operatively associated with the resistor.

On the other hand, the printer 44 of FIG. 3 includes a battery, not shown, that is onboard the cartridge 50 that scans with the printhead 68. The onboard battery reduces the demands placed on the electrical connections between the microprocessor 64 and the printhead 68, since drive signals may be limited to information, rather than a combination of information and power.

The wiring from the microprocessor 64 to the carriage 48 can be eliminated altogether by transmitting the drive signals in a wireless manner. For example, the carriage 48 may have an opening 70 that exposes an infrared sensor 72 mounted to the side of the inkjet cartridge 50. A transmitter, not shown, may be mounted to the housing of the drive motor 62 to transmit serial data to the infrared sensor 72. A flex circuit may then be used to electrically link the sensor 72 to the printhead 68.

Other optical transmission techniques may be used. Rather than infrared transmission, visible light may be employed if the housing 46 of the printer 44 blocks the entrance of the extraneous light to the sensor 72. Alternatively, a fiberoptic cable may be mounted from the microprocessor 64 to the carriage 48, and a fiberoptic receptor may be formed in the inkjet cartridge 50 to receive serial information from the fiberoptic cable. As an alternative to optical transmission of signals, electromechanical transmission may be employed. The microprocessor 64 may be linked to a radio frequency transmitter and the carriage 48 or the cartridge 50 may then have a receiver for the wireless reception of drive signals.

In one embodiment described above, the carriage 48 or the cartridge 50 includes an onboard battery, while drive signals are transmitted to the printhead 68 by conventional interconnect techniques. The drive signals can then be informational only. In a second embodiment, the drive signals are transmitted in a wireless fashion, but the power is supplied to the printhead 68 using conventional wiring techniques from the power source to the carriage 48 and to the cartridge 50.

Figure 4:
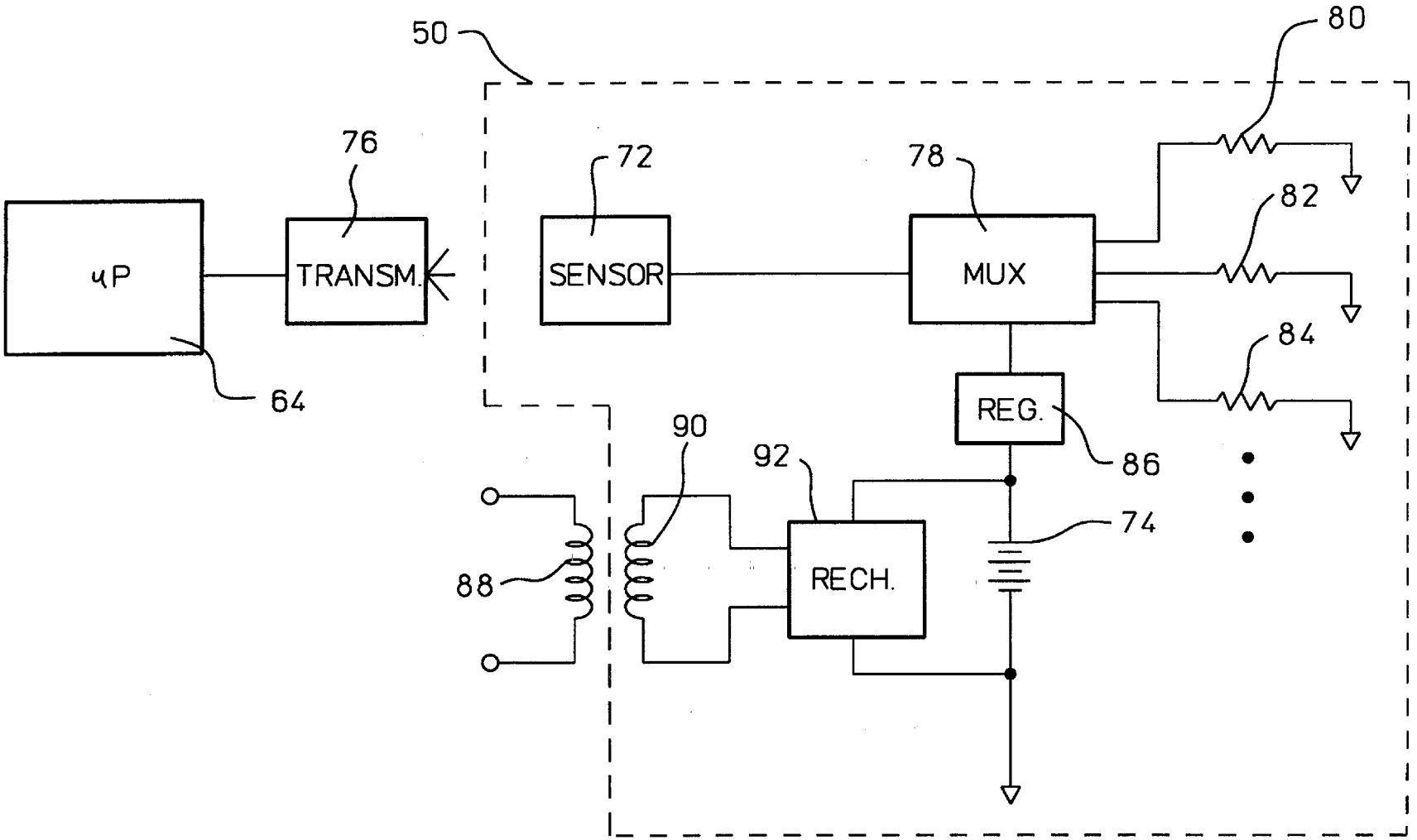
FIG. 4 is a schematical view of the circuitry of the printer of FIG. 3.

A third, preferred embodiment is shown in FIG. 4. In the illustrated embodiment, a battery 74 is located onboard the inkjet cartridge 50, as is a sensor 72 for wireless reception of serial information. A transmitter 76 sends the information from the microprocessor 64. Decoding takes place at circuitry that includes a multiplexer 78. In response to information received at the sensor 72, one or more resistors 80, 82 and 84 receives a voltage pulse that causes the resistor to heat up. The resistors 80–84 are of the type well known in the art for forming a drop ejector of an inkjet printer. The number of resistors will correspond to the number of drop ejectors.

The multiplexer 78 selectively connects the resistors 80–84 to the onboard battery 74. Also shown in FIG. 4 is a power-conditioning circuit 86 to regulate battery power from the battery 74 to the resistors. The power-conditioning circuit 86 ensures that the voltage level to the resistors is substantially the same regardless of whether one resistor or all of the resistors are actuated at one time. The power-conditioning circuit may be integrated onto a single semiconductor chip having the sensor 72, for example, if the sensor is an edge-sensitive infrared detector. However, the type and the location of the power-conditioning circuit are not critical to the present invention. In fact, the resistors 80–84, the power-conditioning circuit 86 and the decoding and multiplexing circuitry 78 are preferably all formed using semiconductor processing of a printhead. That is, each of the elements is contained on a semiconductor chip that is conventionally employed in fabricating an inkjet printhead.

The battery 74 may be a rechargeable device or a non-rechargeable device. If the inkjet cartridge 50 is a disposable cartridge, the battery 74 is preferably non-rechargeable, thereby discouraging users from attempting to refill a cartridge which is intended to be non-refillable.

If the inkjet cartridge 50 is designed for periodic refilling, a non-rechargeable battery 74 should be mounted in a manner to facilitate replacement. However, in the preferred embodiment the battery is rechargeable. For example, a primary coil 88 may be fixed in position for inductive coupling to a proximity coil 90 that is onboard the inkjet cartridge 50. Recharging current to the battery 74 will then be provided by a recharge circuit 92 whenever the proximity coil is sufficiently close to the stationary primary coil to generate alternating current from the proximity coil 90 to the recharge circuit 92. Recharge circuits are known in the art and can be fabricated on the same semiconductor chip containing the resistors 80–84.

Referring now to FIGS. 3 and 4, the primary coil 88 may be mounted on or near a service station 94. A conventional service station of an inkjet printer is a region at one end of the bi-directional movement of the carriage 48, and may include a head wiper mechanism, a sled, and/or a peristaltic pump. The service station is typically at the side of the printer 44 at which the carriage 48 is brought to a rest position following a printing operation. Thus, the proximity coil 90 is inductively coupled to the primary coil 88 when the carriage is in the rest position near the service station 94.

Alternatively, the primary coil 88 generates an electromagnetic field that is broken each time the coil 90 is moved back and forth across the scan path of the printhead 68. It is possible to instead use the primary coil in a recharging function when the carriage 48 is at rest and in an information-transmitting function during the printing operation. That is, the primary coil 88 may be electrically connected to the microprocessor 64 to electromechanically transmit drive signals for operating the inkjet nozzles of the printhead.

While the type and size of battery 74 is not critical to the present invention, alkaline, nickel-cadmium, and lithium ion batteries are considered to be particularly suitable. The size depends upon the particular use. Merely for exemplary purposes, the thermal inkjet cartridge 50 will be considered as storing 40 cc (0.04 L) of ink, and the nozzles will be considered as having a drop volume of 140 pL and a drive energy of 14 μJ. Thus, (0.04 L/140 pL)×14 μJ=4000 J of energy are required to completely empty the cartridge. For an alkaline battery, the battery performance is considered to be 460 J/cc and the cost is approximately 50000 J/$. A NiCad battery has a battery performance of 590 J/cc and a cost of 5000 J/$, while a lithium ion battery has a performance of 1400 J/cc at a cost of approximately 2700 J/$. Thus, the battery volume required to deplete the cartridge may be as great as 4000 J/(460 J/cc)=8.7 cc using the alkaline battery, and as little as 4000 J/(1440 J/cc)=2.8 cc using the lithium ion battery. The cost of the battery for depleting the cartridge is between 4000 J/(50000 J/$)=$0.08 using the alkaline battery and as little as 4000 J/(2700 J/$)=$1.48.

I claim:

1. A scanning head printer comprising:

a stationary base having a shaft, a displaceable assembly, slidably engaging said shaft, having a reciprocating head means for printing on a sheet of material, said reciprocating head means including an array of inkjet nozzles in fluid communication with a supply of ink and operatively associated with a plurality of resistors that heat sufficiently to cause at least one drop of ink to eject from a nozzle;

a battery mounted onto said displaceable assembly to maintain a fixed position relative therewith during operation, said battery being electrically connected to provide a source of current solely to heat said resistors in response to said drive signals; and means, attached to said base, for moving said displaceable assembly along a print path.

2. The printer of claim 1 further comprising receiving means for wireless reception of said drive signals, said receiving means being electrically connected to said reciprocating head means to selectively actuate said reciprocating head means and being physically mounted to said displaceable assembly; and a transmitter for wireless transmission of said drive signals to said receiving means, said transmitter being mounted to said stationary base;

said receiving means having a varying position relative to said transmitter during printing.

3. The printer of claim 2 wherein said receiving means is a receiver for optical reception of remotely generated drive signals.

4. The printer of claim 1 further comprising a fixed means for recharging said battery, while said head means reciprocates proximate to a rest position.

5. The printer of claim 4 wherein said recharging means includes a first coil and a source of alternating current electrically connected to said first coil.

6. The printer of claim 5 further comprising a second coil mounted onto said displaceable assembly and electrically connected to said battery, said second coil being stationary relative to said battery during printing, said second coil disposed to be within a magnetic field of said first coil while said head means reciprocates during operation.

7. The printer of claim 2 wherein said receiving means includes an infrared sensor.

8. A scanning head printer comprising:

a stationary base, having a shaft;

a displaceable assembly, slidably engaging said shaft, having a reciprocating head means for printing on a sheet of material, said reciprocating head means including an array of inkjet nozzles in fluid communication with a supply of ink and operatively associated with a plurality of resistors that heat sufficiently to cause at least one drop of ink to eject from a nozzle;

transmitter means for irradiating drive signals, said transmitter means being fixedly mounted to said stationary base;

wireless reception means, fixedly attached to said displaceable assembly, for receiving said drive signals irradiated by said transmitter means; and means, operatively coupled to said displaceable assembly, for selectively displacing said displaceable assembly along a linear print path;

wherein said drive signal are transmitted from said transmitter means to said reception means in a wireless fashion and said head means releases ink from said supply of ink in response to said drive signals.

9. The printer of claim 8 further comprising a battery electrically and mechanically fixed to said displaceable assembly to provide a source of current solely to heat said resistors, with the relative position of said displaceable assembly and said battery being constant during printing.

10. The printer of claim 8 wherein said transmitter means is a source of lightwave energy.

11. The printer of claim 10 wherein said transmitter means is an infrared light source and wherein said reception means is an infrared sensor.

12. A scanning head printer comprising:

a stationary base having a shaft;

a reciprocating print means, slidably engaging said shaft, for printing on a sheet of paper;

means, operatively coupled to said print means, for selectively moving said print means relative to said base along a path extending from a first extreme position to a second extreme position;

a rechargeable battery fixed to said print means, said battery and said print means having a constant relative position therebetween during printing;

a primary circuit fixed to said base for generating an electromagnetic field across said path; and a secondary circuit fixed to said print means, said secondary circuit disposed for inductive coupling with said primary circuit, said secondary circuit being electrically connected to said battery to provide recharging power to said battery, while said print means reciprocates during operation.

13. The printer of claim 12 wherein said primary circuit includes a coil adjacent to said first extreme position of said print means, said first extreme position being a rest position.

14. The printer of claim 12 wherein said print means includes an inkjet printhead.

15. The printer of claim 12 further comprising a reciprocating optical sensor coupled to said print means and a stationary optical transmitter coupled to said base for wireless transmission of drive signals from said stationary optical transmitter to said reciprocating optical sensor.

16. The printer of claim 15 wherein said optical sensor is a sensor of infrared radiation.

* * * * *